United States Patent [19]

Bellis et al.

[11] Patent Number: 4,622,189

[45] Date of Patent: Nov. 11, 1986

[54] FLAT PRODUCTS COMPRISING AT LEAST TWO BONDED LAYERS

[75] Inventors: John Bellis; Roy Mathers, both of Clywd, Wales

[73] Assignee: Mixalloy Limited, Clywd, Wales

[21] Appl. No.: 763,544

[22] Filed: Aug. 7, 1985

[30] Foreign Application Priority Data

Aug. 10, 1984 [GB] United Kingdom ..... 8420326

[51] Int. Cl.[4] ..... B22F 7/02

[52] U.S. Cl. ..... 264/112; 419/3; 419/36

[58] Field of Search ..... 419/3, 36, 37, 43, 69; 428/548; 264/109, 125, 112, 113; 29/DIG. 31; 425/81.1

[56] References Cited

U.S. PATENT DOCUMENTS

| | | | |
|---|---|---|---|
| 2,341,732 | 2/1944 | Marrin | 419/43 |
| 3,152,892 | 10/1964 | Clark | 419/43 |
| 4,141,482 | 2/1979 | Reynolds | 419/43 |

FOREIGN PATENT DOCUMENTS

| | | |
|---|---|---|
| 1163766 | 9/1969 | United Kingdom . |
| 1291496 | 10/1972 | United Kingdom . |
| 1313795 | 4/1973 | United Kingdom . |
| 1528484 | 10/1978 | United Kingdom . |
| 2059443 | 4/1981 | United Kingdom . |
| 2068117 | 8/1981 | United Kingdom . |

*Primary Examiner*—Michael Ball

*Attorney, Agent, or Firm*—Kinney & Lange

[57] ABSTRACT

A method of producing strip comprising at least two material layers of different chemical composition bonded one to another, in which separate slurries of powders of different chemical compositions are formed in film-forming cellulose derivatives. Dried layers in strip form are produced from the slurries and these layers are fed, while under tension in interfacial contact, into the nip of a pair of compaction rolls to effect a mechanical bond between the layers. At least one of the strip layers may be subjected to a sintering operation prior to being fed into the nip of the compaction rolls.

10 Claims, 1 Drawing Figure

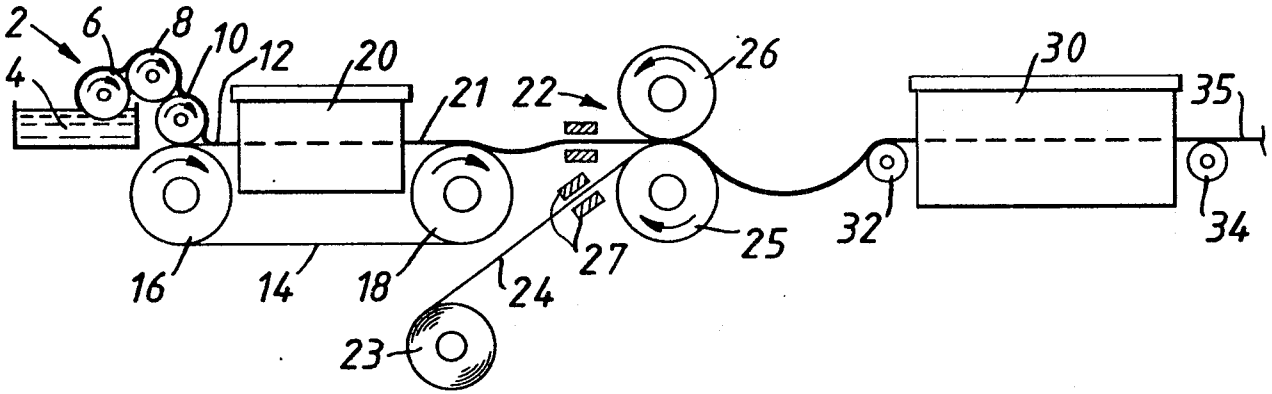
2
4
6
8
10
12
20
21
22
26
30
35
34
32
25
27
24
18
23
14
16

FLAT PRODUCTS COMPRISING AT LEAST TWO BONDED LAYERS

BACKGROUND OF THE INVENTION

This invention relates to flat products such as strip or sheet (hereinafter referred to simply as "strip") comprising at least two bonded layers of metallic or non-metallic material of different chemical composition.

The invention has application to bi-metallic or tri-metallic strip intended for use as temperature sensitive elements in thermostats, circuit breakers and the like devices which produce mechanical movement or develop a force in response to temperature change. The invention is, however, not limited to such application and is applicable to the production of a wide range of multi-layered strips where the properties of one surface or layer are required to be different from those of other surface(s) and/or layer(s). Thus, one surface or layer may act as a catalyst or react chemically with another surface or layer when the strip is subjected to specified conditions.

It is known to produce multiple layer strip by welding or otherwise bonding together two or more relatively thick metal slabs and progressively reducing the combined thickness of the contiguous bonded slabs by hot or cold rolling, a heat treatment where required being interposed between working operations. This method for producing strip in addition to being costly requires a high level of care and displays a relatively high reject rate which adds further to the cost of strip having the required characteristics. In particular, it is well known that a high standard of surface cleanliness is required and that, consequently, the available time between cleaning and bonding is very limited, in some cases a matter of seconds. In addition, extremely high rolling pressures are required to achieve the 50% or more reduction in thickness needed in one roll pass to promote roll bonding between the layers, each of which is 100% dense.

It is also known to produce strip from metal powder in which a coating of a slurry comprising a suspension of metal powder in a binder composition is deposited onto a support surface, the slurry being dried, removed from the support surface and rolled to form a green strip. Hitherto, however, it has proved to be impracticable to produce a multiple layer strip from such strips due to difficulties in achieving a consistent and satisfactory interfacial contact between superimposed strips and an inability to produce at reasonable cost a satisfactory mechanical bond between the strips. The former difficulty arises because of a tendency for one or each strip to move in a direction parallel to the axes of rotation of the compaction rolls.

SUMMARY OF THE INVENTION

The present invention sets out to provide a method for producing strip of at least two layers of metallic and/or non-metallic material of different chemical composition which overcomes the above mentioned disadvantages.

According to the present invention in one aspect there is provided a method of producing strip comprising at least two material layers of different chemical composition bonded one to another, the method comprising forming separate slurries of powders of different chemical compositions in film-forming cellulose derivatives, producing from said slurries dried layers in strip form and feeding the dried strip layers while under tension in interfacial contact into the nip of a pair of compaction rolls to effect a mechanical bond between the layers.

At least one of the strip layers may be subjected to a sintering operation prior to being fed while under tension in interfacial contact with the other strip layer or layers into the nip of the compaction rolls.

The tension imposed on each strip as it enters the nip of the compaction rolls should be sufficient to prevent movement of the strip in a direction parallel to the axes of rotation of the rolls thereby ensuring correct alignment of the respective strips to achieve the required interfacial contact.

Tension may be imposed and controlled by means of pressure pads, pinch rolls or the like located in advance of the compaction rolls. Alternatively, one or each strip may be passed over and in contact with a stationary surface movable towards and away from the strip path to vary the imposed tension.

The imposed tension may be varied continuously or intermittently in response to a measured process or strip parameter. The strip may comprise layers of metallic material of different chemical composition; alternatively, the layers may be of non-metallic materials or a combination of metallic and non-metallic materials. A roughened surface may be produced on one or each surface of one or each strip layer to enhance the mechanical bond between adjacent strip layers. This may be achieved by, for example, lightly brushing the surface(s) of dried compacted layer(s) with a dry or dampened brush or the like. Alternatively, where the powder has magnetic properties, the layer(s) may be passed through a magnetic field prior to drying.

According to the present invention in another aspect there is provided a method of producing strip including two layers of different chemical composition bonded one to the other, the method comprising the steps of forming separate slurries of powders of different chemical compositions and of different viscosities in film forming cellulose derivatives, producing from said slurries layers in strip form, the viscosity of one such layer being such that a cellulose-rich upper surface is produced, subjecting the said one layer to a heat treatment which reduces the cellulose rich upper surface to produce a coarse finish on one strip surface, and feeding the strip layers in interfacial contact while under tension into the nip of a pair of compaction rolls to effect a mechanical bond between the layers.

At least one of the strip layers may be subjected to a sintering operation prior to being fed while under tension in interfacial contact with the other strip layer or layers into the nip of the compaction rolls.

According to the present invention in a still further aspect, there is provided a method of producing strip comprising at least two layers of different chemical composition bonded one to another, the method comprising depositing a slurry of one or more powders and a film-forming cellulose derivative as a layer onto a support surface, heating the deposited slurry layer to promote gelling of the film-forming cellulose derivative, and to dry the slurry layer to produce a self supporting strip removing the dried strip from the support surface and feeding it while under tension in interfacial contact with a second strip of a chemical composition different to that of the dried strip into the nip of a pair of compaction rolls to effect a mechanical bond between the layers.

To improve the mechanical bond between the strip layers, metallic or non-metallic particles may be applied to one surface of at least one of the strip 25 layers before compaction of the layers in interfacial contact.

In each of the foregoing aspects in which an improved mechanical bond is achieved by producing a coarser surface finish to one strip layer, the roughness produced is preferably between 50 and 300 micro inches roughness average (Ra) value.

Following compaction, the bonded strip layers may be subjected to one or more additional heat treatments and/or reductions.

For metallic strip, the composition of the metal in any layer may be determined by incorporating into the cellulose derivative powders of different metals with or without any non-metallic additive capable of modifying metal characteristics, the combination of different metals producing the required composition. Alternatively, the composition of metal in any layer may be determined by incorporating into the cellulose derivative, metal powder which already is of the composition required and which may be produced by any of conventional means such as alloying. If necessary, the metal composition of any one layer or layers may be produced by a combination of powder of individual metal and alloys.

In a preferred embodiment of the invention, each layer is produced by depositing onto a moving support a slurry of the powder or powders and the film forming cellulose derivative and, subsequently, removing each layer from the respective support surface for concurrent compaction under tension within a compaction mill.

Suitably the cellulose derivative is methyl cellulose or methyl hydroxy ethyl cellulose; in this case, an aqueous slurry is deposited upon a moving support which is heated to promote gelling of the methyl cellulose; gelling which occurs at a temperature in excess of about 40° C. conveniently is followed by drying to remove water and produces a self supporting film or layer referred to as "flexistrip". The flexistrip can be removed from the moving support with relative ease for subsequent compaction.

In a yet further aspect, the invention provides multilayered strip produced by one of the methods referred to above.

BRIEF DESCRIPTION OF THE DRAWING

The invention will now be described by way of example only, with reference to the accompanying drawing in which the sole FIGURE is a schematic side view of apparatus in accordance with the invention. The drawing illustrates apparatus for producing strip comprising two layers of metal of different composition. Such strip may comprise bi-metallic strip of well known type conveniently used in the production of thermostats and like heat sensitive devices in which differential expansion of the layer on sensing heat produces mechanical movement.

DETAILED DESCRIPTION OF THE PREFERRED EMBODIMENTS

Typical bi-metallic strip for such heat sensitive applications have metal compositions in adjacent layers as detailed in Table 1 below; these however are merely examples of a wider range of composition combinations of metallic and non-metallic materials which can be produced by the apparatus of the invention. Typical examples of such compositions are also given in Table 1.

TABLE 1

| High Expansion Component | Low Expansion Component |
|---|---|
| 22-25% Ni; 3-8.5% Cr; bal. Fe | 36-50% Ni; balance Fe |
| 20% Ni; 6% Mn; balance Fe | 36-42% Ni; balance Fe |
| Ni | 36% Ni; balance Fe |
| 18% Ni; 11% Cr; balance Fe | 30% Cr; balance Fe |
| 19% Ni; 7.25% Cr; balance Fe | 38% Ni; 7.25% Cr; bal Fe |
| 22% Ni; 3% Cr; balance Fe | Ni |
| 14%; 9.5% Mn; 5% Al; bal Fe | 36% Ni; balance Fe |
| 72% Mn; 18% Cu; 10% Ni | 36% Ni; balance Fe |

In the apparatus shown when used for producing bi-metallic strip, a slurry 4 is retained in a vessel at a station indicated generally at 2. The slurry conveniently is based upon multiples of 300 g of methyl cellulose treated with glyoxal as a solubility inhibitor together with 12 liters of water optionally containing suitable slurrying and wetting agent. Incorporated in the aqueous methyl cellulose is 35 kg of a suitable fine metal powder typically of below 80 B.S. mesh, the particles having a composition by weight of 22% Ni and 3% Chromium the balance being iron except for incidental impurities. The concentration of the metal powder in the aqueous slurry is approximately 75% by weight, although lower or higher concentrations may be used according to the mechanical and thermal properties which are required.

The metal powder may be produced by any conventional means, for example, by atomising the appropriate alloy metal; it is intended to produce in the bi-metallic strip or layer of metal of the powder composition detailed; however, the metal composition in the layer may alternatively be produced by incorporating into the aqueous methyl cellulose, a mix of unalloyed metal powders.

At station 2 the slurry 4 is transferred by way of train of rollers 6, 8 onto a coating roller 10 arranged uniformly to deposit slurry to a selected thickness and width onto the region 12 of a continuous belt 14 of inert metal such as stainless steel looped around drums 16 and 18.

Other means of slurry deposition, for example curtain coating or extrusion, may however be employed.

Drive applied to at least one of the drums feeds the belt through a drying oven 20 which is effective initially to raise the temperature of the deposited slurry layer to above 45° C. to induce gelling of the methyl cellulose to form a film and subsequently to drive water from the gelled slurry; the gelled and dried slurry film emerges from the drying oven as a flexible and self supporting strip 21 which can be continuously peeled off from the polished surface of belt 14 which conveniently is pretreated to ensure easy release. The flexible and self supporting strip 21 peeled off the exit end of the belt 14 at drum 18 is referred to as 'flexistrip'.

Disposed adjacent the exit end of belt 14 at drum 18 is a coil 23 of flexible and self supporting strip 24 which has previously been produced by a coating line such as that shown in the drawing and which has been similarly stripped off the belt prior to coiling in conventional manner and then subjected to a sintering operation. Strip 24 is produced in like manner to that of strip 21; however the composition of the metal powder used to produce strip 24 is generally of different composition and possibly of different thickness to that of strip 21; however in this embodiment, the pre-sintered metal strip 24 is 36% by weight of nickel with the remainder being iron except for incidental impurities.

At station 22, flexistrip 21 derived directly from the coating plant together with pre-sintered strip 24 derived from the previousy produced coil 23 are simultaneously fed, one superimposed on the other into the nip between a pair of rolls 25, 26 effective to produce the first stage of compaction together of individual particles in strips 21 and 24 as well as simultaneous compaction together of the strips.

A level of back tension is imposed on each of the strips entering the roll nip by means of friction pads 27, the tension being sufficient to prevent movement of the strips in a direction parallel to the rotational axes of the rolls. Other means of imposing the required back tension can be employed these including the use of pinch rolls and stationary surfaces movable towards and away from the strip path to vary the tension imposed.

The level of tension imposed may be preset or may be varied during strip production in dependence of a measured process or strip parameter.

While the adjustment of the mill rolls would depend upon thickness of the strips 21 and 24, as well as the concentration of metal powder in the slurry, a pressure effective to produce about 30% reduction of gauge is acceptable for the metal compositions detailed.

While bonding flexistrips which have not previously been subjected to a sintering operation, a gauge reduction of approximately 60% would be achieved.

It will be appreciated that the rolling pressures required are significantly less than those necessary when rolling wrought strips since each strip 24 is not fully dense.

After the first stage of compaction and bonding at the rolls 25, 26 the strip is fed through a sintering furnace 30 by way of inlet and outlet guide rolls 32 and 34 respectively.

The sintering furnace 30 is generally of the belt or roller hearth type containing an atmosphere which is non-oxidising to the materials being processed.

Alternatively, a flotation furnace in which the strip is supported on a gaseous cushion may be employed. In the sinter furnace, which has a temperature plateau determined by the metals in the layers and is in the embodiment about 1150° C., the methyl cellulose in the compacted and bonded flexistrips 21, 24 becomes fugitive while the metal particles in the layers as well as the layers themselves become further bonded.

The strip leaving the sinter furnace 30 by way of guide roll 34 is now effectively bi-metallic strip having a strip density of approximately 90% of full density and having two bonded layers of metal respectively having the composition of the metal powder incorporated in the aqueous slurries at the coating stations.

After leaving the sintering furnace the bi-metallic strip 35 may be subject to further sintering or heat treating operations to produce a material of full density with the mechanical thermal corrosion and wear resistant characteristics required.

The separate slurries of powders may have similar or different viscosities. In one embodiment of the invention, the viscosity of one slurry is chosen such that a cellulose-rich surface layer is produced on the strip formed from the slurry. In this embodiment the cellulose derivative employed is preferably methyl hydroxy ethyl cellulose. During subsequent heat treatment this layer reduces to form a coarse finish at one strip surface to provide a good mechanical bond with an adjacent strip during compaction.

Alternatively, the required coarse surface finish may be achieved by lightly brushing the surface of an unsintered compacted flexistrip with a dry or damp brush. Alternatively, when the powder has magnetic properties, coarseness may be produced by passing a strip, while still in the form of a wet slurry film, through a magnetic field.

In a further embodiment, the mechanical keying of one strip to another is achieved by means of metallic or non-metallic particles applied to one strip surface prior to compaction of the layers in interfacial contact. Alternatively, where the hardness of the powder employed allows, mechanical keying is achieved through individual particles of one strip layer being impressed into an adjacent layer during compaction.

In each of the foregoing embodiments where an improved mechanical bond is achieved by producing a coarser surface finish to one or more strip layers, the roughness produced is preferably in the range 50 to 300 micro inches Ra value. Thus, an unsintered flexistrip layer to be bonded to a relatively soft presintered strip layer may contain up to 25% particles larger than the normal particles size of 150 microns.

It will be appreciated that while the invention has been described with reference to bi-metallic and multi-metallic strip incorporating layers of metal of specific composition, strips of other compositions may equally be produced by suitable selection of the powders which are incorporated in the slurries from which the intermediate flexistrip is produced. Table 1 lists a wide range of composition of bi-metallic and multi-metallic strip which are of commercial interest, for thermostats and the like heat sensitive devices and which may be produced by the method of the invention.

It will also be appreciated that while methyl cellulose has been described as a film forming cellulose derivative capable of producing a self supporting and flexible green strip, other cellulose derivatives having similar properties may equally be employed. As in the case of methyl cellulose these may incorporate anti-foaming agents and the like.

We claim:

1. A method of producing strip comprising at least two material layers of different chemical composition bonded one to another, the method comprising forming separate slurries of inorganic powders of different chemical compositions in film-forming cellulose derivatives, producing from said slurries dried layers in strip form and feeding the dried strip layers while under tension in addition to that due to their own weight in interfacial contact into a nip of a pair of compaction rolls to effect a mechanical bond between the layers.

2. A method as claimed in claim 1 wherein at least one of the strip layers is subjected to a sintering operation prior to being fed while under tension in interfacial contact with the other strip layer or layers into the nip of the compaction rolls.

3. A method as claimed in claim 1 wherein tension is imposed and controlled by means of pressure pads, located on an entry side of the compaction rolls.

4. A method as claimed in claim 1 wherein tension is imposed and controlled by means of pinch rolls located on an entry side of the compaction rolls.

5. A method as claimed in claim 1 wherein one or each strip is passed over and in contact with a stationary surface movable towards and away from the strip path to vary the imposed tension.

6. A method as claimed in claim 1 wherein the powder selected for one slurry has a hardness and/or coarseness greater than the powder selected for the other slurry whereby on feeding the resulting dried strip layer through the nip of the compaction rolls individual particles of greater hardness of one strip layer are impressed into a surface of the other strip layer to effect a mechanical bond there between.

7. A method as claimed in claim 6 wherein the other dried strip layer is subjected to heat treatment prior to bonding with the layer containing the powder of greater hardness and/or coarseness.

8. A method of producing strip including two layers of different chemical composition bonded one to the other, the method comprising the steps of forming separate slurries of inorganic powders of different chemical compositions and of different viscosities in film forming cellulose derivatives, producing from said slurries layers in strip form a viscosity of one such layer being such that a cellulose-rich upper surface is produced, subjecting the one layer to a heat treatment which reduces the cellulose rich upper surface to produce a coarse finish on one strip surface, and feeding the strip layers in interfacial contact while under tension in addition to that due to their own weight into a nip of a pair of compaction rolls to effect a mechanical bond between the layers.

9. A method as claimed in claim 8 wherein at least one of the strip layers is subjected to a sintering operation prior to being fed while under tension in interfacial contact with the other strip layer or layers into the nip of the compaction rolls.

10. A method of producing strip comprising at least two material layers of different chemical composition bonded one to another, the method comprising depositing a slurry of one or more inorganic powders and a film forming cellulose derivative as a layer onto a support surface, heating the deposited slurry layer to promote gelling of the cellulose derivative and to dry the slurry layer to produce a self supporting strip, removing the dried strip from the support surface and feeding it while under tension in addition to that due to their own weight in interfacial contact with a second strip of a chemical composition different to that of a dried strip into the nip of a pair of compaction rolls to effect a mechanical bond between the strips.

* * * * *